US005842587A

United States Patent [19]

Wanek et al.

[11] Patent Number: 5,842,587

[45] Date of Patent: Dec. 1, 1998

[54] OFFSETTING LINK ASSEMBLY FOR FOLDING LUFFING JIB

[75] Inventors: Michael J. Wanek, Two Rivers; Robert J. Walker; Daniel L. Krajnik, both of Manitowoc, all of Wis.

[73] Assignee: Manitowoc Crane Group, Inc., Reno, Nev.

[21] Appl. No.: 916,738

[22] Filed: Aug. 19, 1997

Related U.S. Application Data

[63] Continuation of Ser. No. 609,059, Mar. 4, 1996, abandoned.

[51] Int. Cl.[6] ..... B66C 23/70

[52] U.S. Cl. ..... 212/177; 212/300; 212/347

[58] Field of Search ..... 212/177, 299, 212/300, 347

[56] References Cited

U.S. PATENT DOCUMENTS

| | | | |
|---|---|---|---|
| 1,929,416 | 10/1933 | Fykse et al. | 212/177 |
| 2,529,454 | 11/1950 | Marcantonio . | |
| 3,085,695 | 4/1963 | Miller . | |
| 3,306,470 | 2/1967 | Green et al. . | |
| 3,323,660 | 6/1967 | Allin | 212/177 |
| 3,557,969 | 1/1971 | Heyer | 212/177 |
| 3,831,771 | 8/1974 | Wiencek | 212/300 |
| 4,106,631 | 8/1978 | Lundy . | |
| 4,383,616 | 5/1983 | Sterner et al. . | |
| 4,394,914 | 7/1983 | Privat . | |
| 4,484,686 | 11/1984 | Mentzer . | |
| 4,491,229 | 1/1985 | Behrendt et al. . | |
| 4,653,655 | 3/1987 | Rathi et al. . | |
| 4,828,124 | 5/1989 | Iga . | |
| 5,082,128 | 1/1992 | Franzen et al. . | |
| 5,111,945 | 5/1992 | Hull et al. . | |
| 5,199,586 | 4/1993 | Pech et al. . | |
| 5,292,016 | 3/1994 | Casavant et al. . | |

FOREIGN PATENT DOCUMENTS

| | | | |
|---|---|---|---|
| 245204 | 2/1966 | Austria | 212/300 |
| 536060 | 4/1993 | European Pat. Off. | 212/300 |

*Primary Examiner*—Thomas J. Brahan

*Attorney, Agent, or Firm*—Steven P. Shurtz; Brinks Hofer Gilson & Lione

[57] ABSTRACT

A crane boom and luffing jib assembly have an offsetting link to allow the luffing jib to fold back and under the main boom for assembly of the boom and luffing jib assembly on a construction site where the entire length of the boom and luffing jib cannot be laid out during assembly. A method of assembling the crane boom and luffing jib comprises the steps of assembling the luffing jib and boom, the luffing jib pivotally attached to the jib connection pivot, the luffing jib folded back and under the boom along a ground surface, the hinged connection allowing neutral axis of the jib boom section to be offset relative to the boom connection pivot; attaching the boom to a crane; raising the boom top upwardly, allowing the jib top to travel along the ground surface until the luffing jib is lifted off the ground surface; causing the jib boom section to be aligned with the jib connection pivot; and inserting hinge pins into the hinged connection to lock the jib boom section in axial alignment with the jib connection pivot. wherein the luffing jib is initially folded back and under the crane boom.

18 Claims, 4 Drawing Sheets

OFFSETTING LINK ASSEMBLY FOR FOLDING LUFFING JIB

This application is a continuation of application Ser. No. 08/609,059, filed Mar. 4 1996, now abandoned.

FIELD OF THE INVENTION

This invention relates to lift-crane booms and luffing jibs, and more particularly to an offsetting link that allows the luffing jib to be folded under and along the main boom, thereby decreasing the area necessary for assembly of the crane at the construction site.

BACKGROUND OF THE INVENTION

Construction cranes having large main booms are often equipped with a luffing jib to allow the crane to reach further from its base when the construction site is such that the swing axis of the main boom is confined, as for example, when neighboring structures obstruct the area through which the main boom can swing. A crane equipped with a luffing jib can raise its main boom at a steep angle relative to the ground surface, and then extend the luffing jib at a shallow angle relative to the ground surface, thereby increasing the crane's reach over such obstructions.

In many cases, the luffing jib may be well over half as long as the main boom, and in some instances may be nearly as long as the main boom. Consequently, a large area is needed at the construction site to lay the boom and luffing jib out during assembly, prior to raising the main boom. Given that the luffing jib design is intended to be used in confined construction sites, it is often impossible to lay out the entire combined length of the main boom and luffing jib. An alternative method of assembling the boom and luffing jib would be to fold the luffing jib under the main boom. However, the main boom has a much larger cross-sectional area than the luffing jib, and the luffing jib does not fold directly under the main boom when the luffing jib connection pivot, the point of attachment of the luffing jib to the main boom, is on or near the neutral axis of the main boom, because the luffing jib would then contact the main boom near the pivot point.

Folding booms have been made with the pivot point moved laterally away from the neutral axis of the boom sections to allow the folding section to clear the main section, as in U.S. Pat. No. 2,529,454 issued Nov. 7, 1950 to Marcantonio, and U.S. Pat. No. 3,306,470, issued Feb. 28, 1967 to Green, et al. Such an arrangement is not possible with a folding luffing jib, however, because the pivot would have to be moved too far off the neutral axis to allow the luffing jib to clear the large main boom.

SUMMARY OF THE INVENTION

In one embodiment, this invention provides a crane boom and hinged luffing jib having a folded set-up configuration, comprising:

(a) a crane boom having a boom top;

(b) a luffing jib pivotally affixed to the boom top, the luffing jib having hinged sections connected to one another in a non-linear manner to allow the luffing jib to fold under the crane boom in the set-up configuration.

In a preferred embodiment, the invention provides a crane boom and luffing jib assembly, comprising:

(a) a crane boom having a boom top and a longitudinal neutral axis;

(b) a luffing jib having a jib butt section pivotally secured to the boom top about a jib connection pivot, a jib boom section secured to the jib butt section, the jib boom section having a longitudinal neutral axis; and (c) an offsetting link structure connecting the jib boom section to the jib butt section such that the jib connection pivot may be offset relative to the longitudinal neutral axis of the jib boom section to allow the luffing jib to fold back and under the crane boom.

A preferred embodiment of the offsetting link comprises a pair of side brackets connected by cross-braces to form a link of the same cross-sectional area as the jib sections to be joined, each side bracket comprising a pair of parallel plates spaced to receive an end of a jib section chord therebetween, the chords retained in the brackets by pins. Preferably, a stop lug is positioned between the plates at the upper end of each bracket to engage an abutment member on the end of the upper members of one of the boom sections to limit the degree of offset allowable when the hinge pins are removed.

In a preferred embodiment, the crane boom and luffing jib assembly includes a pin puller mechanism to remove the hinge pins, comprising:

(a) a winch carrying a cable, the cable passing through a pulley mechanism located between the hinge pins;

(b) the cable attached to the hinge pins, such that taking up cable on the winch causes the hinge pins to be removed from the holes in the offsetting link, thereby allowing the jib boom section to rotate about the axle pin.

In another preferred embodiment, the crane boom and luffing jib are assembled by a method comprising the steps of:

(a) assembling the luffing jib and boom, the luffing jib pivotally attached to the jib connection pivot, the luffing jib folded back and under the boom along a ground surface, the hinged connection allowing the neutral axis of the jib boom section to be offset relative to the boom connection pivot;

(b) attaching the boom to a crane;

(c) raising the boom top upwardly, allowing the jib top to travel along the ground surface until the luffing jib is lifted off the ground surface;

(d) causing the jib boom section to be aligned with the jib connection pivot; and (e) inserting hinge pins into the hinged connection to lock the jib boom section in axial alignment with the jib connection pivot.

In another preferred embodiment, a crane comprises:

(a) an upper works rotatably mounted upon a mobile lower works, the upper works rotatable about a vertical swing axis;

(b) a boom having a longitudinal neutral axis and upper and lower chords spaced outwardly from the boom longitudinal neutral axis to provide buckling strength to the boom, and a luffing jib connection pivot on or near the boom longitudinal neutral axis;

(c) a luffing jib pivotally connected to the boom at the luffing jib connection pivot, the luffing jib also having a longitudinal neutral axis and upper and lower chords spaced outwardly from the jib longitudinal neutral axis to provide buckling strength to the jib, with the jib connection pivot on or near the jib longitudinal neutral axis when the jib is in an operational configuration;

(d) one of said boom or said jib including a hinge longitudinally spaced from said luffing jib connection pivot to allow the longitudinal neutral axis of boom or the jib to be offset relative to the jib connection pivot.

This invention solves the problem of having the luffing jib connected to the boom near the boom longitudinal neutral axis while allowing the luffing jib to be configured in a folded set-up position, under the main boom. By including an offsetting link, or hinge, within the luffing jib, the luffing jib is allowed to bend, clearing the main boom while keeping the pivot point close to the neutral axis of the boom sections. The other advantages of this invention, as well as the invention itself, will best be understood in view of the drawings, a brief description of which follows.

DETAILED DESCRIPTION OF THE DRAWINGS AND PREFERRED EMBODIMENTS

Figure 1:
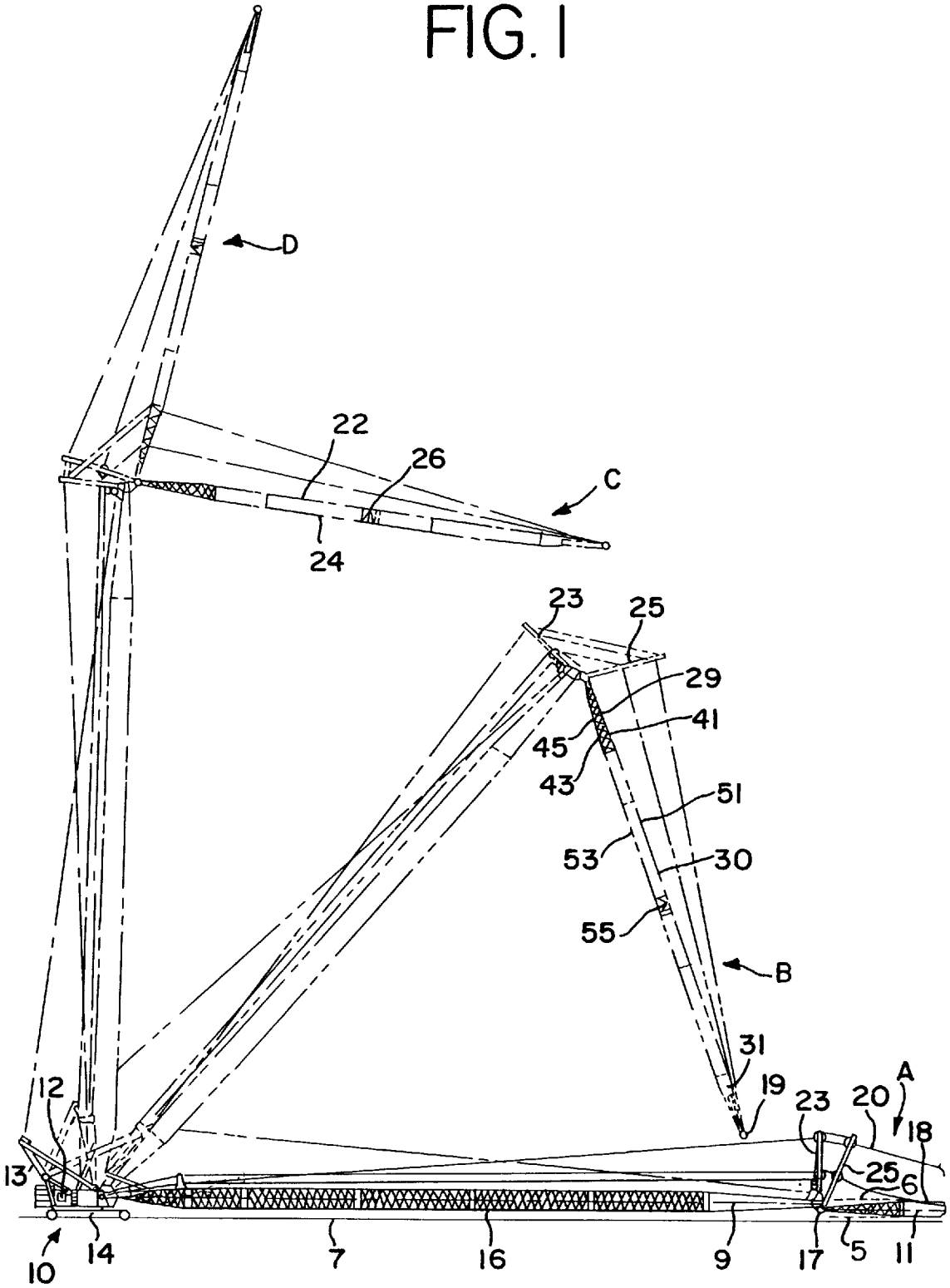
FIG. 1 is a side view of a lift-crane equipped with a main boom and luffing jib in an "out front" layout position, prior to raising the boom. The dashed lines show the operation of raising the boom and luffing jib.

FIG. 1 depicts a lift crane 10 positioned prior to operational deployment in an "out front" layout position. The crane 10 has an upper works 12 pivotally mounted on a lower works 14, the upper works 12 rotatable on the lower works 14 about a vertical swing axis, and a boom 16 to which is pivotally attached a luffing jib 18 at a jib connection pivot 17, each of the boom 16 and luffing jib 18 having a longitudinal neutral axis 9, 11. Preferably, as shown in the drawings, the jib connection pivot 17 is located near enough to the neutral axis 9 of the boom 16 so that the axis of the connection pivot 17 is between planes 3, 4 (FIG. 2) which are parallel to the neutral axis 9 and defined respectively by the upper and lower faces of the boom 16. Also, the jib connection pivot 17 is preferably located near enough to the neutral axis 11 of the luffing jib 18 so that the axis of the connection pivot 17 is between planes 5, 6 (FIG. 1) which are parallel to the neutral axis 11 and defined by the upper and lower faces of the luffing jib 18 when the luffing jib is in an operational configuration. In the "out front" position depicted in FIG. 1, the luffing jib 18 extends directly outwardly from the boom 16, and each of the sections of the luffing jib 18 and boom 16 are coaxially aligned. The luffing jib 18 includes upper chords 22, lower chords 24 and cross-braces 26, and may be equipped with a wheel 19 at the outermost end. The terms "upper" and "lower" chords are chosen with reference to the ground surface 7 when the boom 16 is in a raised position and the luffing jib 18 is extended, as shown in the C position of FIG. 1, and this convention is followed herein. When the luffing jib is folded under the boom, the lower chords 24 will be positioned adjacent the boom, while the upper chords 22 will be positioned adjacent the ground surface 7.

The operation of raising the boom 16 and luffing jib 18 from a set-up position to an operational position is shown in FIG. 1. Although FIG. 1 depicts the raising operation from the "out front" configuration, indicated by position A, the operation is identical for raising the boom 16 and luffing jib 18 from the "folded-under" configuration. As the boom 16 is raised by boom hoist rigging 13, the outermost end of the jib top section 31 travels along the ground surface 7, until the jib top section 31 is lifted off the ground surface 7, after which the luffing jib 18 reaches a point at which it is suspended nearly vertically from the boom 16. At this point, the weight of the luffing jib 18 may cause the sections to align. However, it may be necessary to slightly tension the luffing jib 18 to cause the sections to align. First and second masts 23, 25 are connected to the boom 16 and luffing jib 18 respectively, and preferably, a luffing jib backstop assembly may also be included, as disclosed in U.S. Pat. No. 5,292,016, the disclosure of which is incorporated herein by reference. At least one luffing jib pendant 20 originates on a take-up mechanism on or near the crane upper works 12, traverses the masts 23, 25 and attaches near the outermost end of the luffing jib 18. Tensioning the luffing jib pendant 20 causes the masts 23, 25 to be brought together, thereby raising the luffing jib 18, as indicated by positions B, C and D of FIG. 1.

Figure 2:
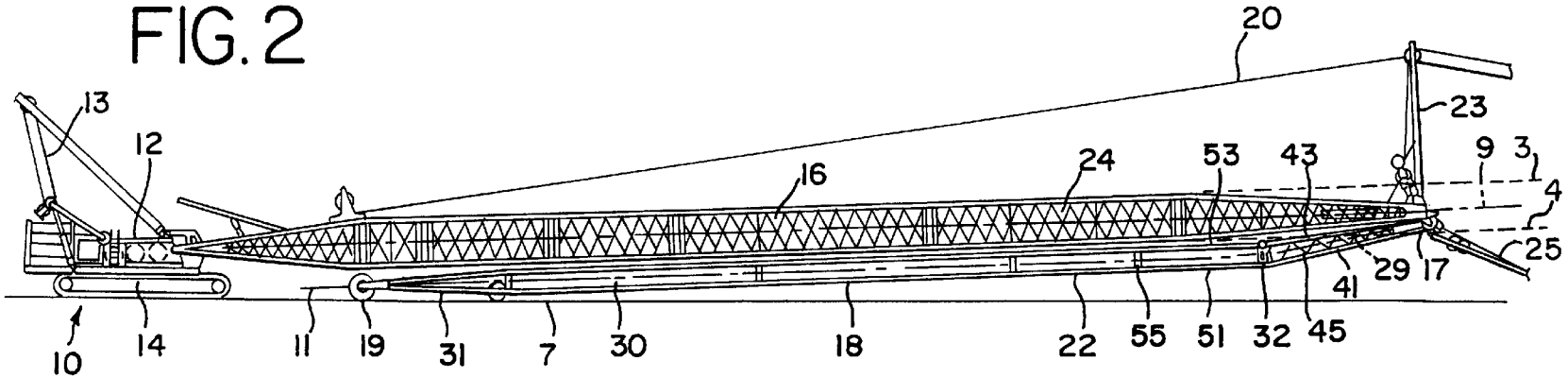
FIG. 2 is a side view of a lift crane equipped with a main boom and luffing jib in the "folded-under" set-up configuration enabled by the present invention.

FIG. 2 depicts the lift crane 10 positioned prior to operational deployment in a folded set-up position. In the folded position depicted in FIG. 2, the luffing jib 18 is folded under the boom 16 and rests on a ground surface 7. The luffing jib 18 comprises a jib butt section 29, a jib boom section 30 and jib top section 31, having a wheel 19 attached to the outermost end. The jib butt section 29 is pivotally attached to the jib boom section 30 by an offsetting link 32.

Figure 3A:
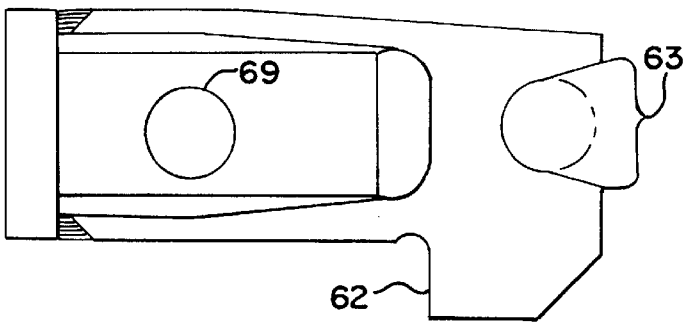
FIG. 3A is a side view of the end of upper chord of the jib boom section showing the points of attachment to the offsetting link.
Figure 3:
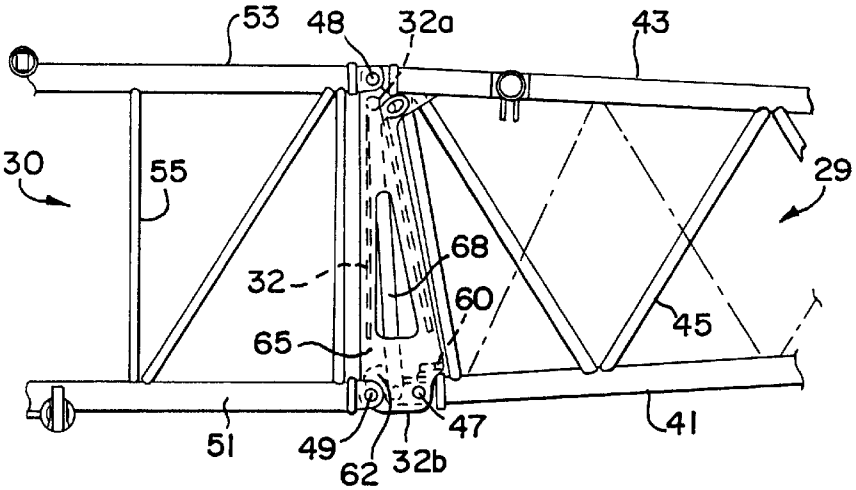
FIG. 3 is an enlarged side view of the junction of the luffing jib butt section and jib boom section, connected by an offsetting link, in a coaxially-aligned orientation.

FIG. 3 is a detailed side view of the connection between the jib butt section 29 and the jib boom section 30, with the jib sections 29, 30 in a coaxially-aligned orientation. Although only one side surface of the structure is shown, it is to be understood that the opposite side of the structure is identical. The jib butt section 29 includes upper chords 41, lower chords 43 and cross braces 45, and the jib boom section includes upper and lower chords 51 and 53 respectively, and cross braces 55. An offsetting link 32 connects the jib butt section 29 to the jib boom section 30. The lower chords 43 of the jib butt section 29 are connected to the lower chords 53 of the jib boom section 30 and the lower chords 43, 53 are connected to the offsetting link 32 by an axle pin 48 that extends through aligned holes in the lower end 32*a* of the offsetting link 32 and the lower chords 43, 53 of the jib sections 29, 30. The upper chords 41 of the jib butt section 29 are connected to the upper end 32*b* of the offsetting link 32 by hinge pins 47. The upper chords 51 of the jib boom section 30 are separately connected to the upper end 32*b* of the offsetting link 32 by pins 49. It should be understood, however, that the offsetting link 32 is not used when the crane is in the operational position, in that when the jib butt section 29 and jib boom section 30 are in the aligned configuration shown in FIG. 3, compression is transferred from the jib boom section 30 to the jib butt section 29, not through the offsetting link 32.

FIG. 3A depicts the end of the upper chord 41 of the jib butt section 29, illustrating the hole 69 aligned with hole 58 in the offsetting link 32 (shown in FIG. 5) to receive hinge pin 47, a notch 63 to contact pin 49 when the jib butt section 29 and jib boom section 30 are in a coaxially-aligned orientation, and an abutment member 62.

Figure 4:
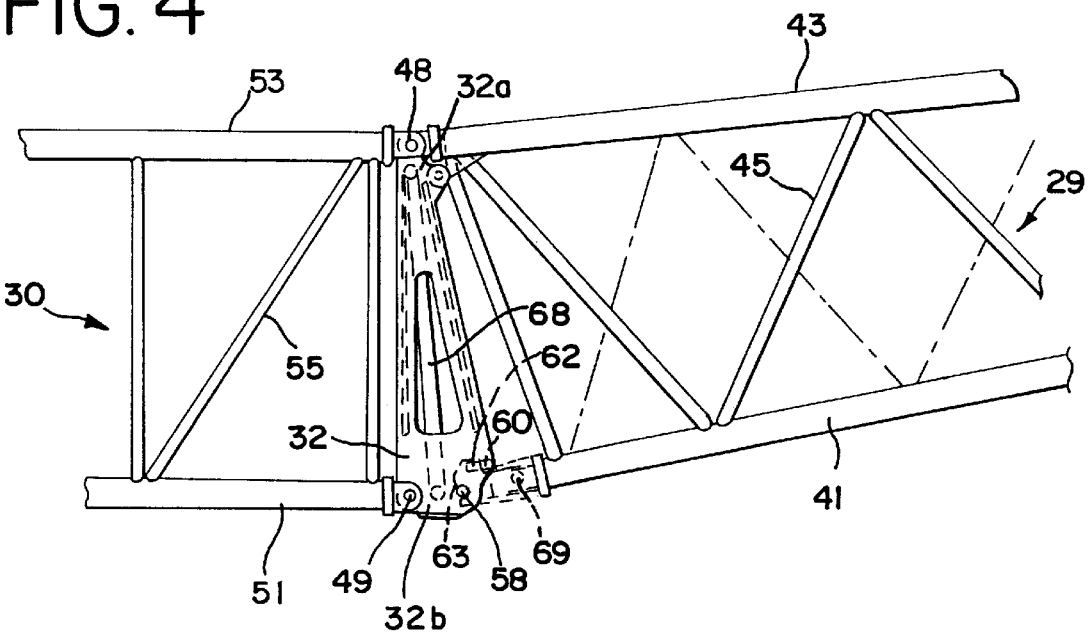
FIG. 4 is a side view of the junction of the luffing jib butt section and jib boom section of FIG. 3, connected by the offsetting link in an offset orientation.

FIG. 4 depicts the connection between the jib butt section 29 and the jib boom section 30 with the jib sections 29, 30 in an axially-offset position. When hinge pin 47 is removed, the jib sections 29, 30 are allowed to pivot on axle pin 48 until a stop lug 60 on the offsetting link 32 contacts an abutment member 62 (FIG. 3A) on the end of the upper chords 41 of the jib butt section 29. Pin 49 remains in place to secure the upper chords 51 of the jib boom section 30 to the offsetting link 32.

Figure 7:
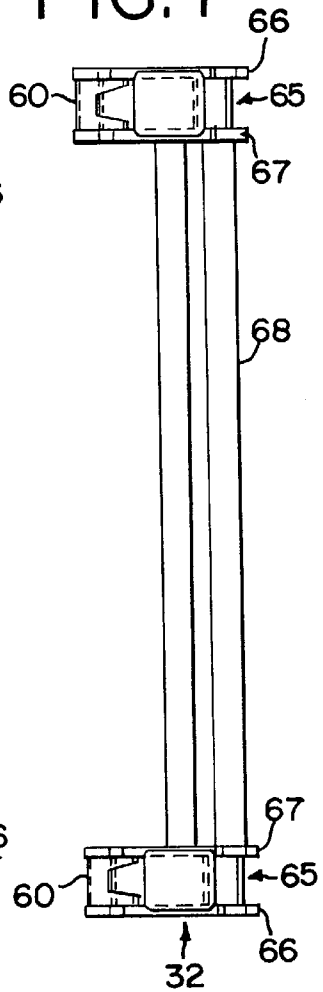
FIG. 7 is a top view of the offsetting link taken along line 7—7 of FIG. 5.
Figure 5:
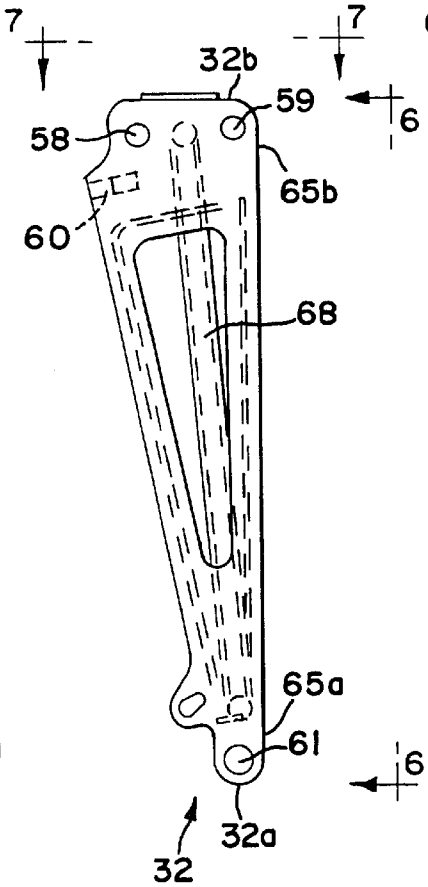
FIG. 5 is a further enlarged side view of the offsetting link of FIG. 3.
Figure 6:
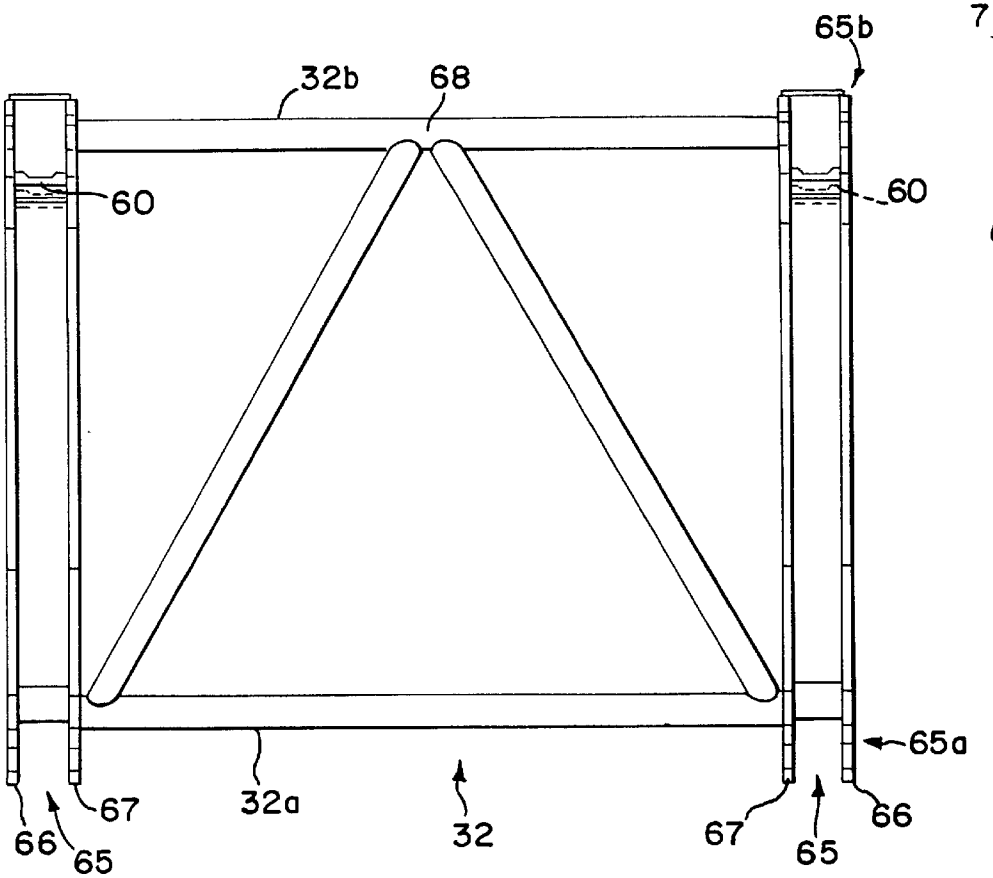
FIG. 6 is a plan view of the offsetting link taken along line 6—6 of FIG. 5.

FIG. 5 depicts the offsetting link 32 in a plane parallel to the longitudinal neutral axis of the jib, while FIG. 6 depicts the offsetting link 32 in a plane perpendicular to the longitudinal neutral axis of the jib. FIG. 7 is a top view of the offsetting link. The offsetting link 32 includes side brackets 65, comprising side plates 66, 67, spaced to form a channel to receive the ends of the boom sections 29, 30, and joined by a stop lug 60. The lower ends 65*a* of the side brackets 65 each have a hole 61 to receive axle pin 48. The upper ends 65*b* of the side brackets 65 each have two holes 58, 59 to receive hinge pins 47 and pins 49 respectively. The side brackets 65 are joined by cross braces 68.

Figure 8:
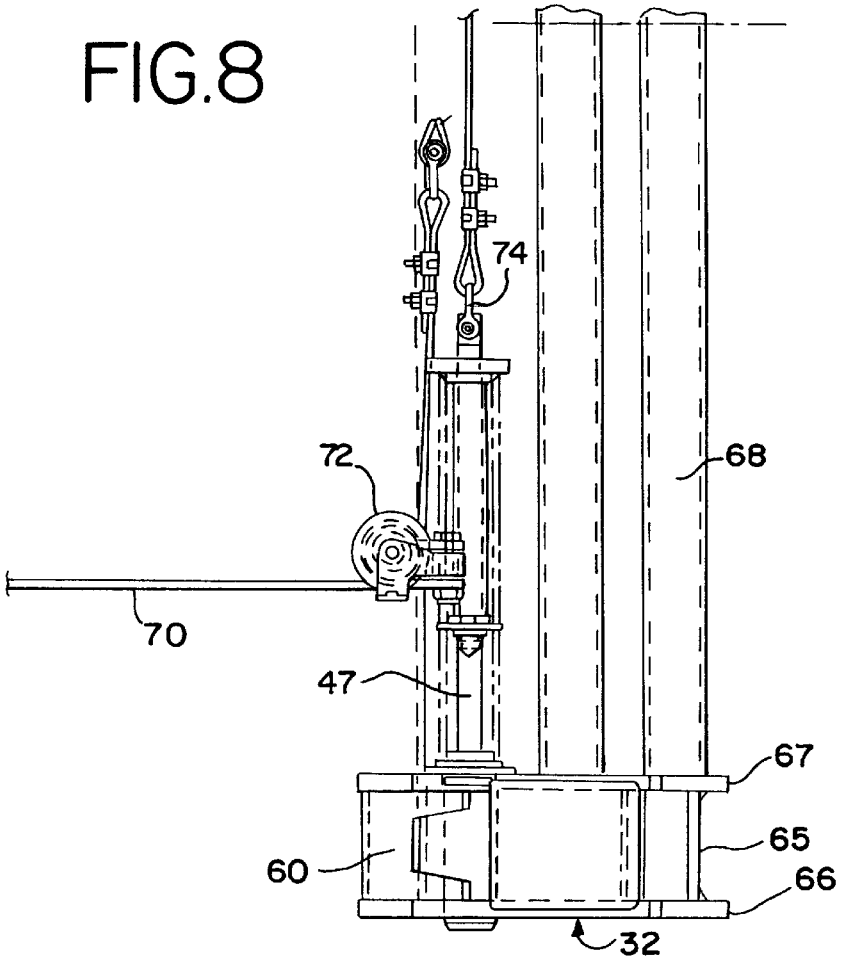
FIG. 8 is a plan view of a pin puller mechanism for use with the offsetting link of FIG. 5.

FIG. 8 depicts a pin puller mechanism to allow the crane operator to remove hinge pins 47 while the boom and luffing jib are raised off the ground. A hand winch (not shown) carries a cable 70, which passes over a pulley mechanism 72, located between hinge pins 47. Although only one hinge pin 47 is shown, it is to be understood that the connections are the same for both hinge pins 47. Cable 70 is directed to both hinge pins 47 and attached to each by means of a ring eye 74 mounted on the head thereof, or by other suitable means. Winding the cable 70 onto the winch causes the hinge pins 47 to be simultaneously retracted.

The crane boom and luffing jib are raised to an operational position as follows, in reference to FIGS. 1–5. With hinge pins 47 retracted, the top of boom 16 is raised upwardly by the boom hoist rigging 13. The luffing jib 18 travels outwardly from the crane 10, rolling along the ground on the wheel 19 attached to the end of the luffing jib 18, until the luffing jib 18 is approximately vertical. When the luffing jib 18 is approximately vertical, hanging from the boom 16 its own weight pulls the jib butt section 29 and jib boom section 30 into coaxial alignment, and the hinge pins 47 are replaced. Alternatively, it may be necessary to slightly tension the luffing jib pendants 20 to swing the jib boom section into alignment. Thereafter, the luffing jib 18 is raised to its operational position.

The foregoing described embodiments should be considered in all respects only as illustrative and not restrictive, and the scope of the invention is, therefore, to be indicated by the appended claims rather than by the foregoing description. All changes which come within the meaning and range of equivalency of the claims are to be embraced within their scope.

We claim:

1. A crane boom and luffing jib assembly, comprising:

(a) a crane boom having a boom top and a longitudinal neutral axis;

(b) a luffing jib having a jib butt section pivotally secured to the boom top about a jib connection pivot, a jib boom section pivotably secured to the jib butt section, the jib boom section having a longitudinal neutral axis; and (c) an offsetting link structure connecting the jib boom section to the jib butt section such that, when the luffing jib is in a folded set-up configuration with the luffing jib folded back and under the crane boom, the link structure allows the jib boom section to move closer to the crane boom than it could if the jib butt and boom sections were in their operational relationship.

2. The crane boom and luffing jib assembly of claim 1, wherein the jib connection pivot is located near the boom neutral axis.

3. A crane boom and luffing jib assembly, comprising:

(a) a crane boom having a boom top;

(b) a luffing jib, comprising a jib butt section pivotally secured to the boom top, a jib boom section pivotally secured to the jib butt section, and a jib top section secured to the jib boom section, each jib section having a longitudinal neutral axis and each jib section having upper and lower chords in relation to a ground surface when the crane boom is raised and the luffing jib is extended parallel to the ground surface; and (c) an offsetting link structure connecting chords of the jib boom section to chords of the jib butt section, the offsetting link being capable of holding the jib boom and butt sections in both a fixed operational relationship and a folded set-up relationship in which the longitudinal neutral axis of the jib boom section is offset relative to the longitudinal neutral axis of the jib butt section.

4. The crane boom and luffing jib assembly of claim 3, wherein the jib top section has a wheel at an outermost end.

5. The crane boom and folding luffing jib assembly of claim 3, wherein the offsetting link comprises:

(a) a pair of side brackets connected by cross braces;

(b) each side bracket comprising a pair of plates spaced apart from each other to form a channel to receive the ends of the lower chords of the jib sections between lower ends of the respective pairs of plates and joined to the offsetting link by an axle pin extending through aligned holes in the plates and the ends of the chords, and the upper chords of the jib sections received between upper ends of the respective pairs of plates, the upper chords of the jib butt section connected to an upper end of the offsetting link by hinge pins extending through aligned holes in the plates and an end of the jib butt section upper chords, and the upper chords of the jib boom section connected to the upper end of the offsetting link by pins extending through a second hole in the plates aligned with holes in an end of the upper chords of the jib boom section.

6. The crane boom and luffing jib assembly of claim 5, further comprising a stop lug between the upper ends of the plates to engage an abutment member attached to an end of the upper chords of the jib butt section to limit the degree of rotation about the axle pins when the hinge pins are removed.

7. The crane boom and luffing jib assembly of claim 6 wherein the hinge pins are removed by a pin puller, comprising:

(a) a winch carrying a cable, the cable passing through a pulley located between the upper ends of the pairs of plates;

(b) the cable attached to the hinge pins, such that taking up cable on the winch causes the hinge pins to be removed from the holes in the offsetting link, thereby allowing the jib boom section to rotate about the axle pin.

8. An offsetting link pivotally connecting two sections of a luffing jib together so that the sections are able to move between an operational relationship and an offset relationship each section having upper and lower chords, the link comprising a pair of side brackets connected by cross-braces, each side bracket comprising a pair of plates spaced to receive an end of a jib section chord therebetween, the chords being retained in the brackets by pins, wherein:

(a) each side bracket has a hole in a lower end of the bracket aligned with holes in an end of the lower chords of the jib sections, and axle pins extending through the holes in the side brackets and through the holes in the lower chords of the jib sections to secure the jib sections to each other and to the offsetting link;

(b) each side bracket has two holes in an upper end of the bracket, one of the holes being aligned with holes in an end of the upper chords of each of the jib sections;

(c) the upper chords of one jib section are secured to the offsetting link by a hinge pin, the upper chords of the other jib section are secured to the offsetting link by a second pin; and (d) a stop lug is positioned between the plates at the upper end of each bracket to engage an abutment member on the end of the upper members of one of the jib sections to limit the degree of offset allowable when the hinge pins are removed.

9. A crane comprising:

(a) an upper works rotatably mounted upon a mobile lower works, the upper works rotatable about a vertical swing axis;

(b) a boom having a longitudinal neutral axis and upper and lower chords spaced outwardly from the boom longitudinal neutral axis to provide buckling strength to the boom, and a luffing jib connection pivot being near enough to the boom longitudinal neutral axis so that the axis of the connection pivot is between two planes, each of which is parallel to the boom longitudinal neutral axis and defined respectively by upper and lower faces of the boom;

(c) a luffing jib pivotally connected to the boom at the luffing jib connection pivot, the luffing jib also having a longitudinal neutral axis and upper and lower chords spaced outwardly from the jib longitudinal neutral axis to provide buckling strength to the jib, with the jib connection pivot being near enough to the jib longitudinal neutral axis when the jib is in an operational configuration so that the axis of the connection pivot is between two planes, each of which is parallel to the jib longitudinal neutral axis and defined respectively by upper and lower faces of the luffing jib;

(d) said jib including a hinge longitudinally spaced from said luffing jib connection pivot to allow the longitudinal neutral axis of the boom or the jib to be offset relative to the jib connection pivot.

10. The crane of claim 9, wherein the hinge joins a jib butt section to a jib boom section, allowing the longitudinal neutral axis of the jib to be offset relative to the jib connection pivot.

11. The crane of claim 9, further comprising at least one luffing jib pendant and first and second masts for raising and lowering the luffing jib, and a luffing jib backstop assembly.

12. The crane of claim 9, wherein said hinge is part of an offsetting link which comprises a pair of side brackets connected by cross-braces, each side bracket comprising a pair of parallel plates spaced to receive an end of the boom or jib chords therebetween, the chords retained in the brackets by pins.

13. The crane of claim 12, the hinge further comprising a stop lug positioned between the plates at an upper end of each bracket to engage an abutment member on the end of the upper chords of the boom or the jib to limit the degree of offset allowable when the pins are removed.

14. The crane of claim 10, wherein the hinge is part of an offsetting link which comprises:

(a) a pair of side brackets connected by cross-braces, each side bracket comprising a pair of parallel plates spaced to receive an end of an upper or lower chord therebetween, the chords retained in the brackets by pins;

(b) each side bracket having a hole in a lower end of the bracket aligned with a hole in an end of the lower chords of the jib butt section and jib boom section, and an axle pin extending through the holes in the side brackets and through holes in the lower chords to secure the jib boom section and the jib butt section to each other and to the offsetting link;

(c) each side bracket having two holes in an upper end of the bracket, one of the holes aligned with holes in the ends of each of the upper chords of the jib butt section, the jib butt section upper chords secured to the offsetting link by a hinge pin, the other of the holes in the side brackets aligned with holes in the upper chords of the jib boom section, the upper chords of the jib boom section secured to the offsetting link by a pin; and (d) a stop lug positioned between the plates at the upper end of each bracket to engage an abutment member on the end of the upper chords of the jib butt section to limit the degree of offset allowable when the hinge pins are removed.

15. A crane boom and hinged luffing jib in a folded set-up configuration, comprising:

(a) a crane boom having a neutral axis and a boom top having an outer surface non-parallel to the neutral axis;

(b) a luffing jib also having a neutral axis, and including a jib section and a butt section hinged thereto, the luffing jib pivotally affixed to the boom top near the boom top neutral axis, the luffing jib being folded back and under the boom along a ground surface in the set-up configuration wherein the jib neutral axis is parallel to the boom neutral axis and said jib butt section extends along said boom outer surface.

16. A method of assembling a crane boom and luffing jib, the boom having a boom top, a longitudinal neutral axis and a jib connection pivot on the boom top, the luffing jib having a jib butt section, a jib boom section having a longitudinal neutral axis, a jib top section and a hinged connection connecting the jib butt section and jib boom section, comprising the steps of:

(a) assembling the luffing jib and boom, the luffing jib being pivotally attached to the jib connection pivot, the luffing jib also being folded back and under the boom along a ground surface, the hinged connection allowing the neutral axis of the jib boom section to be offset relative to the boom connection pivot;

(b) attaching the boom to a crane;

(c) raising the boom top upwardly, causing the jib top section to travel along the ground surface until the luffing jib is lifted off the ground surface;

(d) causing the neutral axis of the jib boom section to be aligned with the jib connection pivot; and (e) inserting pins into the hinged connection to lock the jib boom section in axial alignment with the jib connection pivot.

17. The method of claim 16, wherein the jib top travels along the ground surface on a wheel attached to the jib top.

18. The method of claim 16 wherein the jib connection pivot is located near the longitudinal neutral axis of the boom.

* * * * *

UNITED STATES PATENT AND TRADEMARK OFFICE

CERTIFICATE OF CORRECTION

PATENT NO. : 5,842,587

DATED : December 1, 1998

INVENTOR(S) : Michael J. Wanek et al.

It is certified that error appears in the above-identified patent and that said Letters Patent is hereby corrected as shown below:

In claim 9, line 25, before "said jib" please insert --one of said boom or--.

Signed and Sealed this

Tenth Day of April, 2001

*Attest:*

Nicholas P. Godici

NICHOLAS P. GODICI

*Attesting Officer*

*Acting Director of the United States Patent and Trademark Office*